United States Patent [19]

Fischer et al.

[11] Patent Number: 4,629,175

[45] Date of Patent: Dec. 16, 1986

[54] METHOD AND APPARATUS FOR THE STREAM FEEDING DELIVERY OF SHEET PRODUCTS

[75] Inventors: Emil Fischer, Ludwigshafen-Oggersheim; Rudolf Stäb, Frankenthal, both of Fed. Rep. of Germany

[73] Assignee: Albert-Frankenthal AG, Frankenthal, Fed. Rep. of Germany

[21] Appl. No.: 691,278

[22] Filed: Jan. 14, 1985

[30] Foreign Application Priority Data

Feb. 8, 1984 [DE] Fed. Rep. of Germany ..... 3404459

[51] Int. Cl.[4] ..... B65H 29/66; B65H 29/06

[52] U.S. Cl. ..... 271/202; 271/82

[58] Field of Search ..... 271/202, 203, 72, 182, 271/187, 285, 306, 315, 301, 176, 270, 204, 205, 206, 82, 85; 198/462, 478, 479

[56] References Cited

U.S. PATENT DOCUMENTS

| | | | |
|---|---|---|---|
| 3,186,709 | 6/1965 | Peyrebrune | 271/206 |
| 4,093,203 | 6/1978 | Fischer et al. | 271/202 X |
| 4,424,965 | 1/1984 | Faltin | 271/202 |
| 4,537,390 | 8/1985 | Kiamco et al. | 271/315 X |

FOREIGN PATENT DOCUMENTS

| | | | |
|---|---|---|---|
| 0101546 | 8/1980 | Japan | 271/202 |

*Primary Examiner*—Douglas C. Butler
*Assistant Examiner*—Lawrence J. Goffney, Jr.
*Attorney, Agent, or Firm*—Collard, Roe & Galgano

[57] ABSTRACT

Sheet-like products coming off a folder are firstly transported some distance before being caused to overlap. In order to slow down the products to cause this to take place and to arrange them in a perfectly regular feed stream without being damaged, the products are engaged by grippers that are moved along a preferably arcuate path on a support in the course of which the products are slowed down by the grippers to the speed of a delivery belt on which the products are then deposited.

23 Claims, 2 Drawing Figures

METHOD AND APPARATUS FOR THE STREAM FEEDING DELIVERY OF SHEET PRODUCTS

BACKGROUND OF THE INVENTION

In keeping with one aspect the present invention relates to a method for the delivery of sheet products, wherein the products are firstly transported without, and then later, with overlap, viz. in the form of a stream, and in accordance with a further aspect it relates to an apparatus for performing the method with a stream feed or overlapping unit receiving products from an associated supply device and cooperating with a delivery belt running at a speed lower than that of the supply device.

In the case of one known fan wheel delivery the products after being processed in the folder are supplied by a belt to a fan wheel. The products are laid in the compartments formed between the outwardly radiating wings of the fan wheel and braked thereby. After such compartment has turned through about 90° the product is deposited on a delivery belt. The shortcoming in this respect is that the products are thrown somewhat violently against the wings of the wheel or floors therebetween because of the high kinetic energy of the products so that crashing of the products and damage such as crumpling is likely. A further substantial disadvantage in this respect is that it is not possible to precisely aim the products towards the floors of the compartments. The reason for this is that as the products come off the belt leading to the fan wheel, a number of factors come into play, such as the paper caliper, the number of pages in a product, the nature of the paper and even the amount of ink thereon, which will all affect the motion of the product so that, dependent on the cumulative effect of such factors, the product may land neatly on the compartment floor or may recoil backwards or catch on the end of a wing of the fan wheel. Once the products are irregularly placed on the fan wheel they will be put onto the delivery belt irregularly as well and the product stream thereon is likely to contain laterally displaced, unevenly spaced or skewed products. Further fabrication of the delivered products will then hardly be made more efficient.

In the case of the known slow down delivery equipment the products coming off the folder are decelerated and delivered by cylinders. The folded products are in this case transferred by means of grippers, that are fixed stationarily on the cooperating cylinders, from one cylinder to another and they experience a very abrupt or violent deceleration at the instant of such transfer. However such transfer by grippers is something that is only possible as long as there are still gaps between one product and the next coming from the folder. If the products are to be decelerated even further, as is absolutely necessary for delivery, the stream of products has to be split up into streams. In fact, it is not possible for the products to be overlapped on the cylilnders, because the grippers mounted stationarily on such cylinders have to be accessible, i.e. not buried by the products, for the transfer. Since the products would in such a case where splitting is desired have to be conveyed and guided in two different streams, the system would become overly complex. In this connection it is in fact to be assumed that each such stream ends up at a receiving or further processing station. Apart from this, in the case of the known slow down system the large number of transfers of the products and sudden deceleration thereof means that it is not possible for them to be treated gently and product damage is therefore quite likely.

SUMMARY OF THE PRESENT INVENTION

Taking into account these shortcomings of known equipment, one object of the present invention is to devise an apparatus, which, while keeping the successful features of the known systems, makes possible a gentle and accurate deceleration of the products.

A still further objective of the present invention is to design an apparatus making possible a controlled an precise deposition of the products on the delivery belt.

As part of a still further object the invention is to provide for a single stream delivery of the products.

In the general context of the prior art method taken as a starting point in the present account, the products traveling without overlap are now in the invention to be transferred to grippers which are decelerated, transported by same along a path exceeding the product length, gradually slowed down while moving along said path or distance to a speed lower than the transfer speed and on arriving at a speed generally equal to the stream speed are released again.

The invention furthermore provides an apparatus for effecting the above or other objects in which the stream feed or overlapping unit comprises a support device adjoining the plane of transport of the supply device and defining the path between the supply device and the delivery belt, and a number of rows of grippers rotating between the supply device and the delivery belt to take over the successive products, resting in the part between the supply device and the delivery belt on the support device, from the supply device and to place the products on the delivery belt, such rows of grippers being able to be slowed down by an accelerating drive on a conveying section, running in the direction of motion from the supply device to the delivery belt from approximately the supply speed to approximately the delivery belt speed and are able to be accelerated up to the speed they were moving at before such deceleration in the following section of their motion.

The grippers make possible positive transport of the products and a precise positioning thereof on the way from the supply device to the delivery belt and mean that the products are released at a precisely controlled point in time so that there is a highly accurate alignment of the products on the delivery belt. There is the useful effect that the products are not placed obliquely, laterally out of line or with an uneven spacing, this facilitating further operations on the products, as for example handling by a parcel delivery unit. Since the grippers are firstly decelerated and then accelerated again in the course of each rotation, for example simply by means of known accelerating drives such as a cam or crank drive, it is possible for the products to be placed in an overlapping stream even though they are engaged by grippers so that all the products are delivered in the form of a single feed stream. This facilitates further operations inasfar as there only has to be a delivery or further processing station. The gradual deceleration and acceleration of the grippers and the corresponding change in speed of the products to be braked gives the beneficial effect of a very gentle handling of the products and so makes possible high hourly production rates.

In keeping with a more specially preferred further development of the apparatus of the invention the support device is in the form of a preferably cylindrical drum rotating with a constant speed, and the rows of grippers decelerated and accelerated by the accelerating drive are turned at a speed equal to that of the drum and are mounted so that they may be shifted in relation to the outer face of the drum. As a consequence of the rotary motion of the drum it is therefore possible to reduce relative motion between the grippers transporting the products and the device supporting the products to a minimum, this again being something contributing to gentle treatment of the products. However it is furthermore possible for the drum to be so designed that its surface speed is equal to the arithmetic mean of the transport speed of the supply device and of the delivery belt. The drum used in this case at the same time provides a curved support face defining motion in step with the grippers along a curved path, this making sure that the trailing ends of the products, that are gripped at their leading ends, are forced outwards radially by centrifugal force, this facilitating the overlapping operation.

As part of a convenient further development of the invention the accelerating drive may be so designed that the lowest speed of the rows of grippers is slightly greater than the transport speed of the delivery belt. And this means that the products are less overlapped on the delivery belt.

It is furthermore possible for the rows of grippers to be so driven that their greatest speed is somewhat lower than the transport speed of the supply device. This leads to an automatic introduction of the products into the grippers so that the alignment of products may be adjusted or perfected at the grippers.

As a part of the invention the gripper rows are circumferentially spaced from one row to the next and fit in laterally spaced slots in the outer wall of the drum. The advantage then gained is that parts of the drum are left between the slots so that the drum's outer wall or casing is self-supporting and the drum may be supported by simple bearing means at its ends.

In accordance with a further useful feature of the invention, the rows of grippers are each mounted on two pivoting side levers mechanically connected with the accelerating drive. Because then the rows of grippers are each mounted separately the mass that is to be decelerated and accelerated on each rotation of the system is reduced to a minimum.

As part of a further design feature, the drum with a cylindrical outer wall may be mounted around a coaxial shaft on which furthermore the pivoting levers for the separate rows of grippers are mounted so that they may rock in the peripheral direction, levers placed at opposite ends of the rows of grippers being placed next to each other in two groups. This feature results in a very compact structure and in a simple mechanism.

In accordance with a further outgrowth of the invention the levers may be joined with a driver rotating at an even speed about an axis that is eccentric in relation to the axis of pivoting of the levers, such connection permitting the transmission of torque to the levers from the drivers, same turning at the speed that the levers are to be moved at. If the drum rotates and acts as a support, then this speed will be the same as the speed of the drum. These measures mean that the drive is a crank drive, one of the simplest possible forms of drive capable of causing deceleration and acceleration. There may be a sine-law change in the speed as a further advantage, there then being broad or gradual reversals in the direction of motion where the speed is more or less constant. This means that the products supplied to the grippers are transported away at a relatively high speed so that the respective next sheet may be perfectly engaged and taken up. At the same time this means that in the part of the system coming before the point of deposit of the products on the delivery belt there does not have to be any further change in speed. In this respect a useful effect is produced if the drivers associated with all the levers are attached to a ring that has means for driving it at a desired speed and is placed eccentrically around the shaft on which the levers are mounted. The result is then a particularly compact and simple design of the accelerating drive for all the levers.

In keeping with a further and more especially preferred development of the invention, along the path at which the gripper rows are slowed down there is a cover device which is placed radially clear of the engagement face of the support device and parallel thereto and is preferably in the form of a radially yielding brush structure with bristles pointing towards the support. This cover device gives the useful effect of keeping the products from whipping outwards under the action of centrifugal force and makes certain that they are in fact kept in place on the support device. Because the cover device is able to give elastically in a radial direction, there is however sufficient space for the products to be overlapped. The brush, that is preferably used as part of such cover device only makes contact with the products moving past it so that there is even less chance of any of the products being dislodged.

As part of a further teaching of the invention, the drum and for this reason the path of motion of the grippers on the supply device may be aligned with the direction of the supply device and with the direction of the delivery belt. This means that there is a mutual engagement and therefore a particularly reliable transfer of the products. It is an advantage if the supply device is in the form of a preferably multi-part belt guide, that has a bend next to the drum. This makes certain that the delivery belt is able to be spaced by about 180° around the periphery of the drum from the belt guide forming the supply device. Having the belt guide in more than one part makes it possible for the products to be braked to reduce the gaps therebetween produced by the folding operation.

Further useful developments and features of the invention will be seen from the following account of one working example thereof as based on the drawings.

LIST OF THE VARIOUS VIEWS OF THE FIGURES

DETAILED ACCOUNT OF WORKING EXAMPLE OF THE INVENTION

Figure 1:
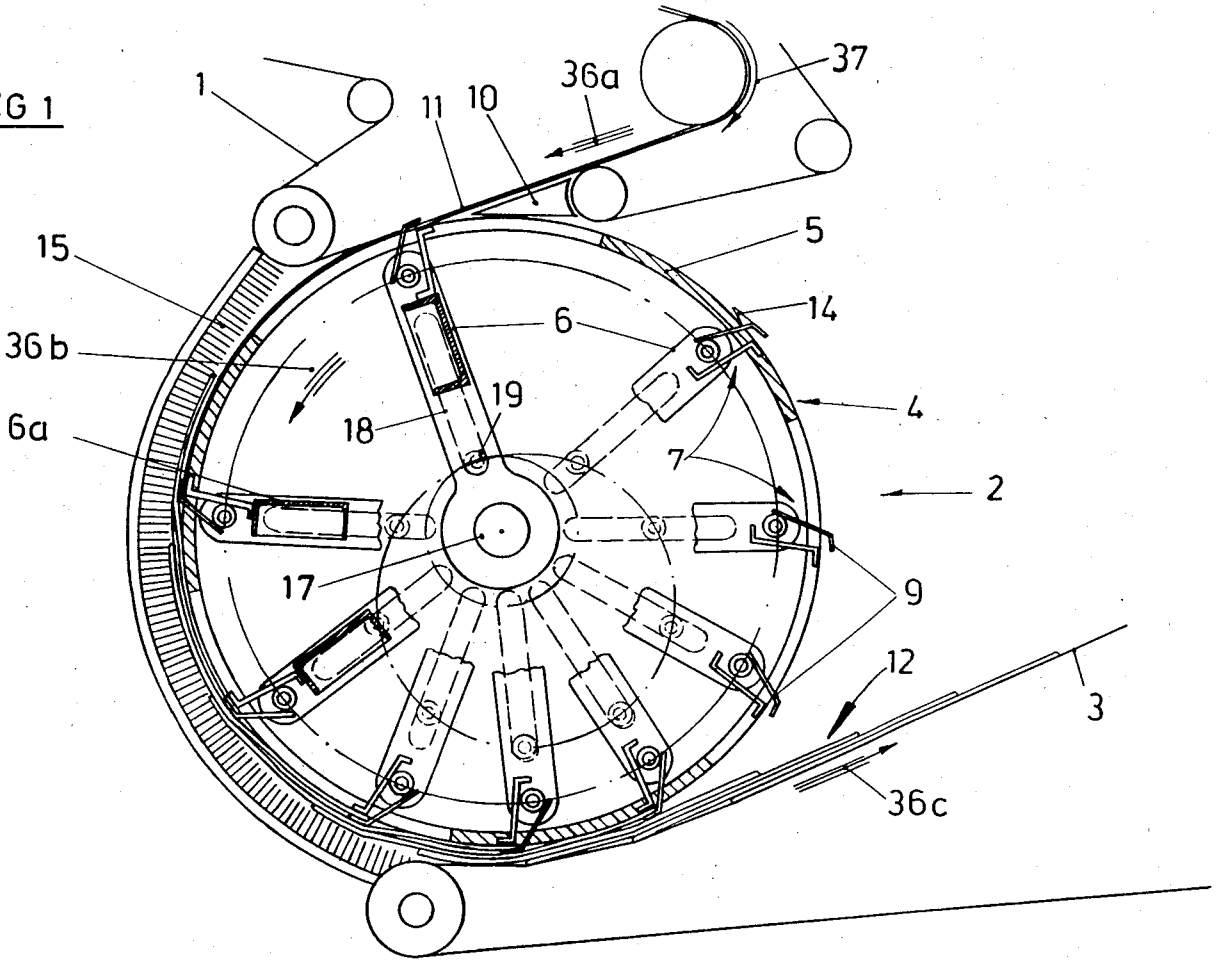
FIG. 1 is a radial section through a preferred form of the overlapping device of the invention.

After coming off a rotary printing press products are folded in a folder and then move on a belt conveyor 1 to an overlapping or stream feeding device 2 in order to put the products in a single feed stream. They leave the overlapping device in this overlapping form on a delivery belt 3 running at a lower speed than the conveyor 1. As the design and workings of a folder are widely known no detailed account is necessary in the present specification. Therefore only the end of the belt conveyor 1 coming from the folder cylinder has been illustrated. The overlapping device 2 to be seen in the figures has as its main parts a drum rotating at a steady surface speed, and which in the present case has a cylindrical outer casing 5 and rows 7 of grippers mounted on pivoting pairs of levers 6 rocking about an axis that is coaxial in relation to the drum axis. The grippers 9 in the rows 7 project through slots 8 in the outer wall 5 of the drum 4. The belt conveyor 1 and the delivery belt 3 meet the drum tangentially at points that are circumferentially spaced by about 180°. The belt conveyor 1 is conventionally made up of sets of belts that receive the products between them. The upper belt set is guided past the drum 4. The lower set of belts has a point of reversal short of the drum 4. Between the ends of two sets of belts there are guide bars 10 defining a support face parallel to the transport plane defined by the belts. The delivery belt 3 on the other hand only has one set of belts placed under the drum 4.

The grippers 9 of the overlapping device 2 are so controlled that they engage the products supplied to the drum 4 by the belt conveyor 1 at the instant that such products come clear of the said conveyor, which constitutes a supply device leading to the drum 4, cause the products to run round half the circumference of the drum 4 and at a point 180° away from the belt conveyor deposit the products on the delivery belt 3. The drive of the pairs of levers 6, each having a row 7 of grippers 9 thereon is at the same speed of turning as the drum 4. At the same time the levers 6 however are decelerated and accelerated in the course of each rotation so that they move at a speed generally equal to the transport speed of the belt conveyor 1 when they receive the products and on depositing the products on the delivery belt 3 they are moving at generally the same speed as it. As a rule the speed of the delivery belt 3 is about one third of the speed of the belt conveyor 1. Because of this difference in speed a set of the grippers 9, holding one of the products 11 at its fold edge, is moved under the trailing edge of the next product 11 in front of it. The products 11 are therefore placed in a stream or overlapping train 12 on the delivery belt 3, even though they have been received by the grippers, so that delivery is in fact in the form of a single and perfectly regular stream of products. During the production of folded signatures gaps develop between one signature and the next. Although these gaps may be reduced to some extent on the belt conveyor 1, there is still a small amount of free space for permitting the grippers 9 to move into the gaps. To make this possible the belt conveyor 1 may have a number of sections run at graduated speeds.

The levers 6 are able to be driven so that the highest speed, as needed on taking over the products 11 by the grippers 9 mounted on the levers 6, is the same as the speed of the belt conveyor 1 and therefore the same as the speed of the products 11 that are to be taken over. In the structure illustrated the levers 6 are so driven that the maximum speed of the grippers 9 is a little higher than the transport speed of the belt conveyor 1 so that the products 11 to be received are reliably snapped up by the opened grippers 9 and undergo alignment at the same time. The grippers 9 of each row 7 may have aligned engagement edges in order to ensure such neat and precise alignment.

The lowest speed, needed when the products are released and deposited on the delivery belt 3, of the grippers 9 mounted on the levers 6, may be equal to the transport speed of the delivery belt 3. In the present example of the invention, the minimum gripper speed should exceed the transport speed of the delivery belt 3 slightly so that the degree of overlap is somewhat increased. The diameter of the drum 4 steadily running at the same speed as the levers 6 and forming a support for the products 11 held by the grippers 9 is such that the surface speed of the drum 4 is the arithmetic mean of the highest and lowest gripper speed, that is to say about the arithmetic mean of the speed of the belt conveyor 1 and of the delivery belt 3. This means that the displacement of the grippers 9 relative to the outer wall 5 of the drum may be reduced to a minimum during the deceleration and acceleration phase. The slots 8 for the grippers 9 in the outer wall of the drum are therefore comparatively short. The grippers 9 of successive rows 7 are offset in relation to each other in the axial or length direction of the drum 4 so that there are lands or stages 13 between the slots 8, and the drum outer wall 5 is a self-supporting structure with the slots 8 therein. In the present case the grippers each run along a circular path. The products 11 guided and transported by the grippers 9 are therefore urged radially outwards by the centrifugal force so that the grippers 9 of a given gripper row 7 are able to move slightly under the trailing end of the product 11 engaged by the respective preceding gripper row 7. In addition, the grippers may each be provided with wedge-like deflectors 14 (as is marked in FIG. 1 in one case only, in order to simplify the figure). As has been confirmed by testing this is however not necessary if (as here) the path of motion of the grippers is curved. In order to keep the products 9 entrained by the grippers from whipping outwards excessively under the effect of centrifugal force, the part of the circumference of the drum along which there is deceleration between the belt conveyor 1 and the delivery belt 3 is covered by a brush 15 whose bristles point inwards radially. The result is a cover device encompassing the supporting device formed by the drum outer wall 5. Such cover device is elastic in a radial direction and functions to keep the products 11 on the outer wall 5 acting as a support device. On the other hand because of the elasticity of the bristles of the brush in the radial direction, there is sufficient space for the overlapping of the products so that the layer on the circumference of the drum is able to become thicker pari passu with the overlapping process. Since the contact of the brush bristles with the products moving past them is very small in area, the brush 15 may be stationary without any danger of the products being pulled out of position. And it would also be possible for there to be a brush cover system in the form of a belt having bristles thereon or to have a number of roller-like brushes rotating at the same peripheral speed as the drum.

Figure 2:
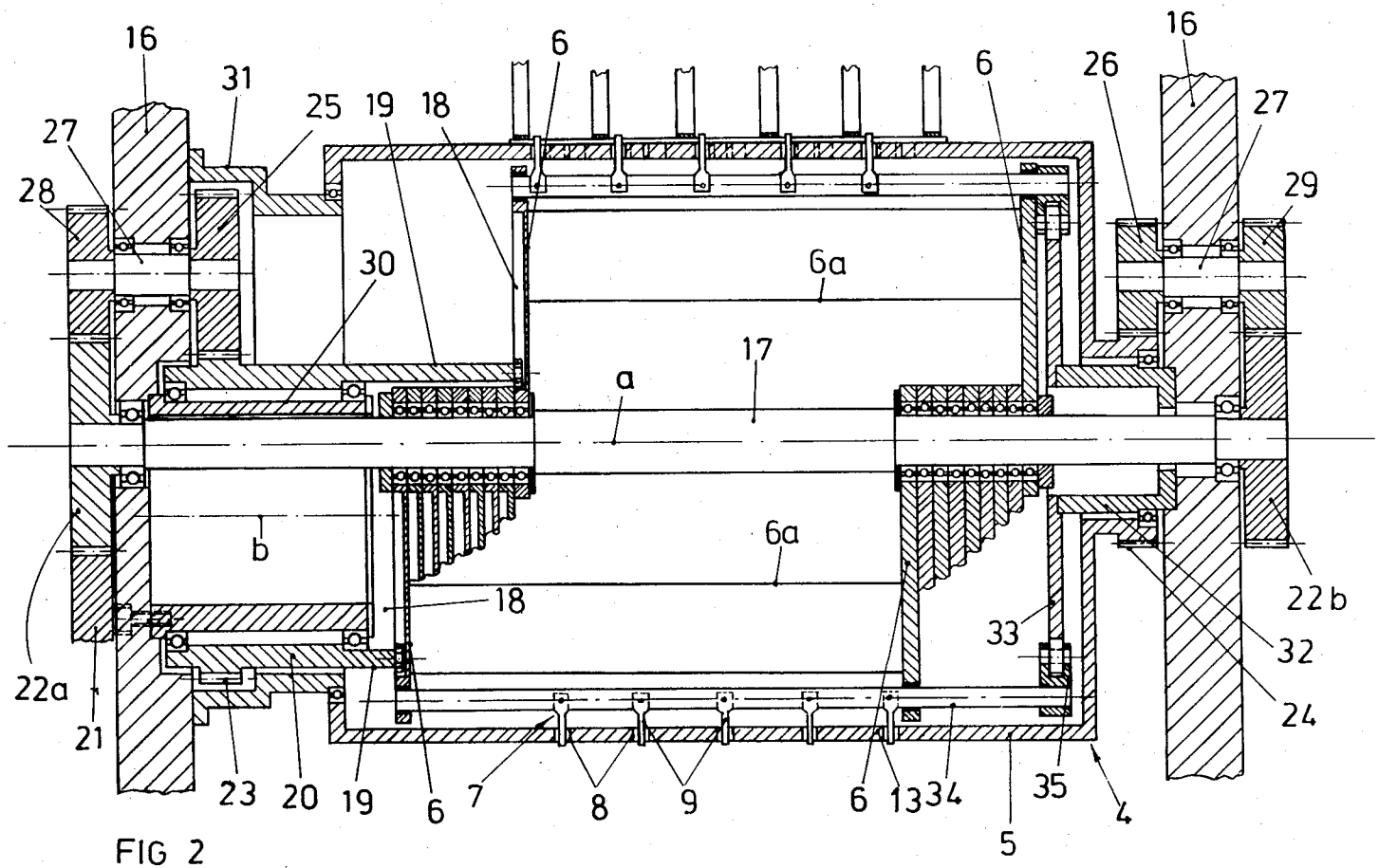
FIG. 2 is a lengthways section through the arrangement of FIG. 1.

The pairs of levers 6 each having a row of grippers 7 mounted thereon are, as may be best seen from FIG. 2, bearinged on a shaft 17 coaxially mounted in the drum 4. The shaft 17 is mounted in bearings in the side frames 16 of the folder. The levers 6 placed at the opposite ends of the rows 7 of grippers are in this respect placed alongside and in contact with each other so that they mutually support each other in the axial direction and for fixing all the levers on one side it is only necessary to have two rings. The pairs levers 6 are in each case joined together as a rocking frame by means of a crosspiece 6*a* therefor. The rocking frames supporting the respective rows 7 of grippers are in the present case driven by means of a crank drive with an eccentric axis of turning b spaced from the common axis a of the shaft 17 and of the drum 4. As part of this driving system one lever 6 of each pair of levers has a driving groove 18 running in a radial direction to receive the respective driver 19 therefor. The levers 6 having a driving groove 18 are placed side by side so that the drivers 19 are all in the form of axial projections on one side of a rotary ring 20 placed next to these levers 6 and around the shaft 17. The ring 20 is centered on the eccentric axis b. The ring 20 and the drum 4 are driven at the same speed of rotation so that mean speed of the grippers 9 is the same speed as that of the drum. The deceleration and acceleration of the grippers 9 in relation to the drum 4 turning at the same speed as the average speed of the grippers, is caused by the spacing or eccentricity of the axes a and b.

The drive of the drum 4 and of the rotary ring 20 is taken from the central shaft 17, that is joined by a chain 21 of gears with a single turn shaft of the folder. The shaft is provided with spur wheels **22*a* and 22*b* on ends running outwards through the side frames 16, one of such wheels meshing with the gear chain 21. The rotary ring 20 is provided with a gear ring 23 next to the nearest side frame 16. The drum 4 possesses a gear ring 24 next to the opposite side frame 16. The gear rings 23 and 24 mesh with respective gear wheels 25 and 26, that are joined with respective gear wheels 28 and 29 on the outsides of the end frames by two shafts 27 passing through such frames. The gear wheels 28 and 29 are in mesh with gear wheels 22*a* and 22*b* keyed respectively on the shaft 17. The pairs of gear wheels for driving the gear rings 23 and 24 have the same step down and step up ratios. If the shaft 17 is already driven with the desired speed of revolution of the grippers and of the drum, the pitch circle diameters of the gear rings 23 and 24 and of the gear wheels 25 and 26 meshing therewith, and of the spur wheels 22*a* and 22*b* and the gear wheels 28 and 29 in mesh with them are in each case to be such that the overall speed ratio for each gear ring 23 and 24 respectively has a value of unity. The rotary ring 20 is bearinged on an inwardly projecting hollow stub shaft 30 fixed to one side frame 16 and having the shaft 17 passing through it. The drum 4 is at one end bearinged on a bearing housing 31 surrounding the rotary ring 20 and the gear wheel 25 cooperating therewith, and at the other end on a bearing housing 32 fixed on the opposite side frame 16 and placed around the shaft 17, said housing 32 being within a hub carrying the gear ring 24 on the drum side. This bearing housing 32 in the present case simultaneously functions as a mount for a cam 33, placed stationarily in the drum outer wall 5, for driving the grippers 9. That is to say, the bearing housing 32 runs past the adjacent end wall of the drum 4 into the interior thereof. The moving jaws of the grippers 9 of each row 7 of grippers are each received on a gripper rod 34 running from end to end of the drum and pivotally mounted in the respective levers 6 thereof. The rod 34 is turned by a means of a follower lever 35 running on the stationary cam 33 for opening and shutting the grippers 9. The stationary jaws of the grippers 9 are mounted in the crosspieces 6*a* of the rocking frames. Having the stationary cam 33 inside the drum makes it possible for the gear ring 24** on the drum to have a relatively small diameter.

The belt conveyor 1 functioning as a supply device and the delivery belt 3 run tangentially towards points on the drum 4 that are circumferentially offset from each other by 180° as has been noted earlier. This makes it possible to arrange for a comparatively long deceleration path with a length substantially exceeding the maximum length of the products so that the products are reliably overlapped. The transport plane of the belt conveyor 1 runs practically tangentially into support face of the drum outer wall 5 functioning as a support device. On the delivery belt side there is a spacing corresponding to the thickness of the stream 12 of overlapped products. The direction of motion of the overlapping device 2 is in this respect such that the drum 4 and the path of motion of the grippers 9 continue from and are continued by the belt conveyor 1 and the delivery belt 3 respectively. In the transfer points there is for this reason motion of the belt conveyor 1, of the drum 4 and its grippers 9 and of the delivery belt 3 in the same direction, as is in fact marked by the arrows **36*a*, 36*b* and 36*c*. This simplifies the transfer of the products. Because of the 180° circumferential offset between the belt conveyor 1 and of the delivery belt 3 the directions of transport of the belt conveyor 1 and of the delivery belt 3 are more or less opposite to each other, see arrows 36*a* and 36*c*. To make this possible in a simple way the belt conveyor 1 is provided with a bend 37 upstream from the overlapping device 2, as will also be seen from FIG. 1. The change in direction of the products caused by this arrangement is cancelled out again by the further change in direction occasioned at the drum 4** so that the overall direction of transport is away from the folder having the overlapping device.

In the illustrated working example of the invention the supporting device for the products 11 is in the form of the rotating drum 4 so that generally no relative motion takes place. However it would furthermore be readily possible for the support device to be formed by curved bars placed stationarily beween the grippers 9 and forming a table where the products are decelerated. In place of a configuration of the deceleration path describing a circular arc it would also be possible to have a more or less straight structure so that there would then be no change in the direction of the belt conveyor needed. The above account will make it clear that the invention is not limited to the working example as described with reference to the figures.

What is claimed is:

1. A stream feeding apparatus for receiving sheet-like products from a supply device at a supply speed and delivering said products in the form of an overlapped feed stream to a delivery belt at a delivery speed that is lower than the supply speed, comprising a cylindrically shaped drum having an outer wall defining a support means and a path of motion which at an uptake end thereof is aligned with a plane of motion of said products as defined by said supply device, said support means having a length in excess of the length of such product as measured in the direction of transport thereof and extending as far as said delivery belt, grippers adapted to move generally parallel to said support means from said supply device to said delivery belt, said grippers being arranged in rows and displaceable relative to said support means, means for pivoting said grippers relative to the outer wall of said drum so as to grip said products at said supply device and release same at said delivery belt, gripper driving means for decelerating said grippers on moving parallel to said support means from generally the same speed as said supply device to generally the same speed as said delivery belt and releasing said products for further transport on said belt and then accelerating said grippers on moving from said delivery belt back to said supply device, and means for driving said drum at a steady angular speed whose speed in complete revolutions in equal to the average angular speed of said grippers.

2. The apparatus as claimed in claim 1 comprising drum driving means adapted to drive said drum at a speed equal to the arithmetic mean of the speeds of the delivery belt and of the supply device.

3. The apparatus as claimed in claim 1 wherein said gripper driving means is adapted to move said grippers at a minimum speed that is at least equal to the speed of the delivery belt.

4. The apparatus as claimed in claim 3 wherein said minimum speed is somewhat in excess of the speed of the delivery belt.

5. The apparatus as claimed in claim 1 wherein said gripper driving means is adapted to move same at a speed which at the most is equal to speed of the supply device.

6. The apparatus as claimed in claim 1 wherein said gripper driving means is adapted to move same at a speed which is somewhat less than the speed of the supply device.

7. The apparatus as claimed in claim 1 wherein said grippers are placed in rows generally parallel to an axis of turning of said drum and are arranged to engage an aligning edge.

8. The apparatus as claimed in claim 1 wherein said grippers are placed in successive rows generally parallel to an axis of rotation of said drum and the grippers in any one such row are axially out of line with grippers in adjacent ones of said rows, said grippers running in slots in said drum wall.

9. The apparatus as claimed in claim 1 wherein at outer ends thereof said grippers are formed with deflectors thereon in the form of wedges.

10. The apparatus as claimed in claim 1 comprising crosspieces running in the direction of an axis of turning of the drum, and pairs of levers, the levers in each pair being fixed to ends of the crosspieces and joined with said gripper driving means for being accelerated and decelerated thereby in relation to said drum on moving around the axis thereof, each of said gripper rows being mounted on one of said crosspieces.

11. The apparatus as claimed in claim 10 comprising a shaft placed coaxially inside said drum and running from end to end thereof, said levers being pivoted on said shaft for circumferential rocking motion in relation to said drum, said levers being placed in two closely stacked groups at ends of said drum, said drum being cylindrical.

12. The apparatus as claimed in claim 11 comprising drivers adapted to move around an eccentric axis that is generally parallel to but spaced from said drum axis, at least one lever of each pair being engaged by one of said drivers, said drivers being arranged to move about said eccentric axis at a speed equal to the speed of said drum.

13. The apparatus as claimed in claim 12 wherein at least one lever of each such pair fixed to each crosspiece has a radially stretching groove therein to receive one of said drivers.

14. The apparatus as claimed in claim 13 wherein said drivers are equally spaced about said eccentric axis, said apparatus comprising a rotary ring centered on said eccentric axis and acting as a driving mount for said drivers and means for driving said rotary ring at the same speed of revolution as said drum.

15. The apparatus as claimed in claim 14 comprising end frames forming part of a folder for processing said sheet products and supplying them to said apparatus, said drum, said shaft and said rotary ring being bearinged in said end frames and having driving means with the same transmission ratio.

16. The apparatus as claimed in claim 15 wherein said drum, said lever support shaft and said rotary ring are separately bearinged in said side frames and are adapted to cause operation of said grippers.

17. The apparatus as claimed in claim 1 comprising a stationary cam placed within said drum, said cam being drivingly connected with said grippers for operation of same.

18. The apparatus as claimed in claim 17 comprising a hub at one end of said drum with a gear ring thereon, said cam being mounted on said hub in said drum and said shaft extending through said hub, and on the other end of said drum a bearing housing surrounding said rotary ring.

19. The apparatus as claimed in claim 1 comprising a cover means placed generally parallel to said support means and capable of yielding in a direction generally normal to said support means.

20. The apparatus as claimed in claim 19 wherein said cover means comprises a brush with bristles pointing towards said support means.

21. The apparatus as claimed in claim 1 wherein said grippers are adapted to receive said products while moving in the same direction as the direction of transport of said supply device and to release them while moving in the same direction as the direction of transport of said delivery belt.

22. The apparatus as claimed in claim 21 wherein said supply device and said delivery belt are adapted to cooperate with said grippers at points spaced 180° apart around said drum for releasing and engaging said products respectively.

23. The apparatus as claimed in claim 21 wherein said supply device is made in at least two sections, joined by a bend, in which said products are transported in reverse directions.

* * * * *